US008915019B2

(12) United States Patent
Schachter et al.

(10) Patent No.: US 8,915,019 B2
(45) Date of Patent: Dec. 23, 2014

(54) SLIDING DOOR STOPPER SYSTEM

(71) Applicant: Fleurco Products Inc., Montreal (CA)

(72) Inventors: Robert Schachter, Montreal (CA); Chi Hai Pham, Brossard (CA); Karina Schatz, Saint Laurent (CA); Nicholas Lee, Saint-Laurent (CA)

(73) Assignee: Fleurco Products Inc., Montreal (CA)

( * ) Notice: Subject to any disclaimer, the term of this patent is extended or adjusted under 35 U.S.C. 154(b) by 0 days.

(21) Appl. No.: 13/753,181

(22) Filed: Jan. 29, 2013

(65) Prior Publication Data

US 2014/0173990 A1 Jun. 26, 2014

(51) Int. Cl.
*E05D 13/00* (2006.01)

(52) U.S. Cl.
USPC ..... 49/425; 49/409; 16/82; 4/610

(58) Field of Classification Search
USPC ..... 49/425, 409, 410, 411; 4/607, 610, 557; 16/82
See application file for complete search history.

(56) References Cited

U.S. PATENT DOCUMENTS 3,333,363 A * 8/1967 Garvey ..... 49/425
3,658,398 A * 4/1972 Abbate et al. ..... 312/333
4,788,744 A * 12/1988 Warner ..... 16/85
4,872,287 A * 10/1989 Block ..... 49/449
5,233,724 A * 8/1993 Lei tert et al. ..... 16/86 A
5,461,829 A * 10/1995 Lehto et al. ..... 49/409
5,718,083 A * 2/1998 Dowdell, II ..... 49/407
5,895,089 A * 4/1999 Singh et al. ..... 296/207
6,052,867 A * 4/2000 Haab et al. ..... 16/87.6 R
6,202,798 B1 * 3/2001 Friedman et al. ..... 187/333
6,438,795 B1 * 8/2002 Haab et al. ..... 16/85
6,487,752 B1 * 12/2002 Mathews ..... 16/86 B
6,516,575 B2 * 2/2003 Haab et al. ..... 52/243.1
7,346,939 B2 * 3/2008 Perry ..... 4/557
7,360,824 B2 * 4/2008 Nakayama et al. ..... 296/190.11
7,621,586 B2 * 11/2009 Fischer et al. ..... 296/155
7,886,403 B2 * 2/2011 Nezu et al. ..... 16/87 R
8,215,061 B2 * 7/2012 Gosling et al. ..... 49/409
8,261,500 B2 * 9/2012 Sprague ..... 52/243.1
8,336,972 B2 * 12/2012 Haab et al. ..... 312/322
8,375,638 B2 * 2/2013 Martin et al. ..... 49/409
8,381,354 B2 * 2/2013 Haab et al. ..... 16/91
8,402,606 B1 * 3/2013 Tsai ..... 16/49

(Continued)

FOREIGN PATENT DOCUMENTS

EP 504595 A1 * 9/1992 ..... A47K 3/22

*Primary Examiner* — Jerry Redman
(74) *Attorney, Agent, or Firm* — Eric L. Lane

(57) ABSTRACT

A sliding door assembly for use with a tub or shower enclosure, said assembly comprising a rod, having a first end and a second end extending along said enclosure; at least one door, having a top, bottom, first end, second end, first surface and second surface;

at least one roller attached to said door at a predetermined position and slidably engaging said rod; a stopper attached to said rod, at a predetermined position; a striker attached to said door, at a predetermined position; said striker further comprising at least one striking member; said stopper further comprising at least one striking member receiver;

wherein when said door is in a first position, said at least one striking member and said at least one striking member receiver are not engaged and when said door is in a second position, said at least one striking member and said at least one striking member receiver are engaged, preventing said at least one door from substantial horizontal and vertical movement along said rod.

10 Claims, 22 Drawing Sheets

(56) References Cited

U.S. PATENT DOCUMENTS

| | | | | |
|---|---|---|---|---|
| 2004/0177437 | A1* | 9/2004 | Perry | 4/557 |
| 2005/0241866 | A1* | 11/2005 | Nakayama et al. | 180/89.12 |
| 2005/0242623 | A1* | 11/2005 | Nakayama et al. | 296/190.11 |
| 2005/0242624 | A1* | 11/2005 | Nakayama et al. | 296/190.11 |
| 2006/0145007 | A1* | 7/2006 | Melberg et al. | 244/118.5 |
| 2008/0092452 | A1* | 4/2008 | Chubb et al. | 49/458 |
| 2009/0241445 | A1* | 10/2009 | Sprague | 52/243.1 |
| 2009/0267383 | A1* | 10/2009 | Fischer et al. | 296/155 |
| 2010/0242370 | A1* | 9/2010 | Trulaske, Sr. | 49/410 |
| 2011/0179718 | A1* | 7/2011 | Martin et al. | 49/413 |
| 2012/0031008 | A1* | 2/2012 | Martin et al. | 49/413 |

* cited by examiner 130
120
25
24
25

11
12
13
130
120
14
40

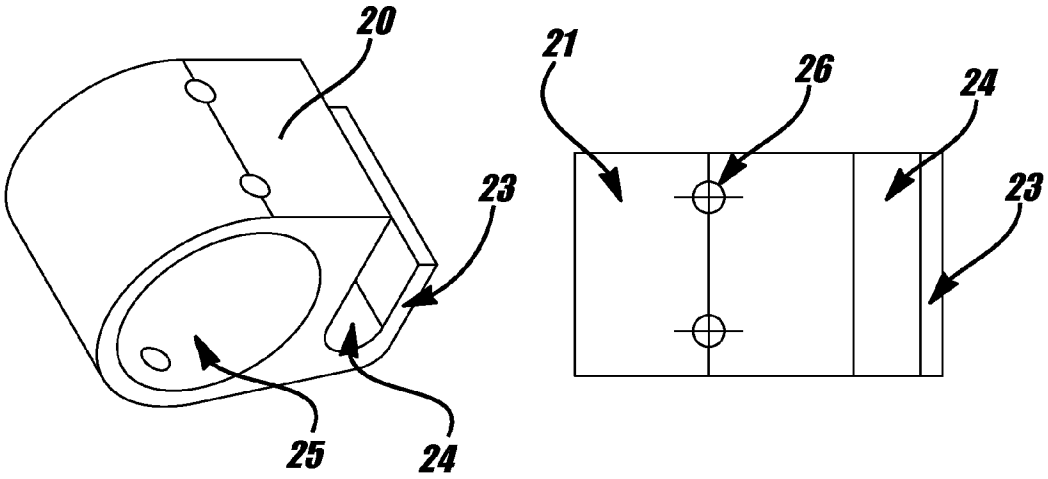
FIGURE 9A
FIGURE 9C
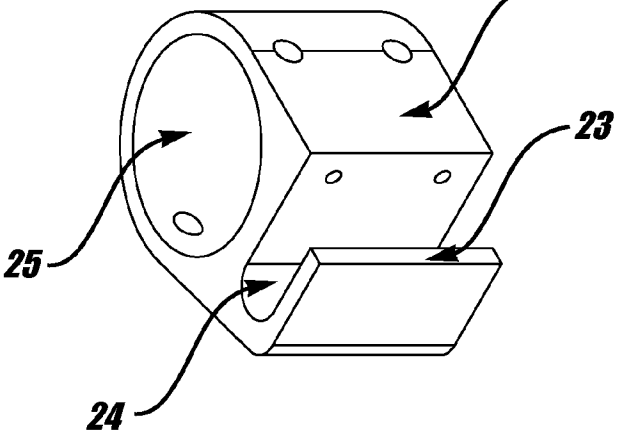
FIGURE 9B
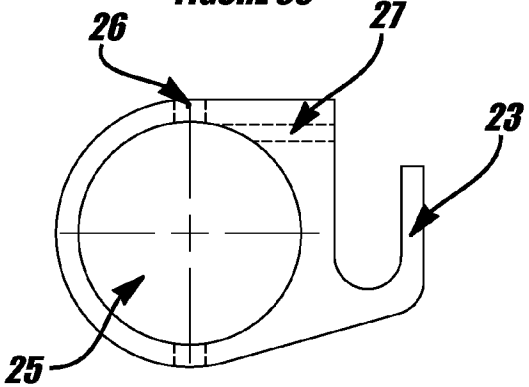
FIGURE 9D
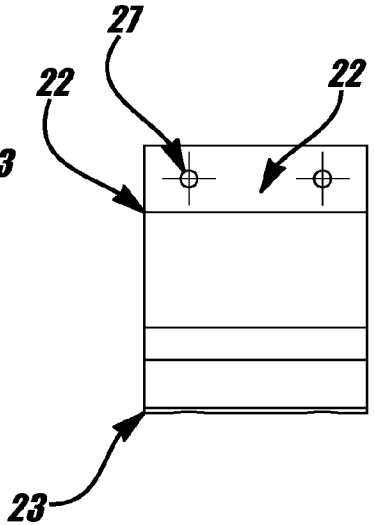
FIGURE 9E 13
41
41'
42
46
47
50
50'
51
52
53
55
57
A
A FIGURE 13A
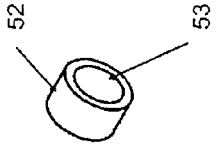
FIGURE 13B
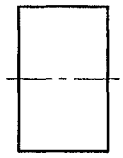
FIGURE 13C
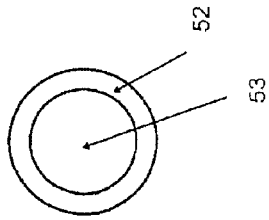
FIGURE 14A
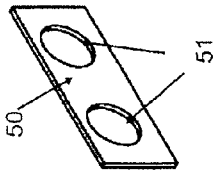
FIGURE 14B
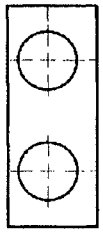
FIGURE 14C
FIGURE 15A
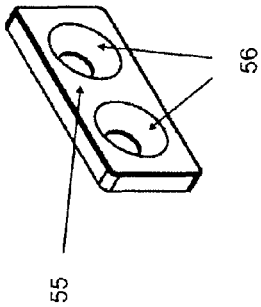
FIGURE 15B
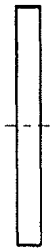
FIGURE 15C
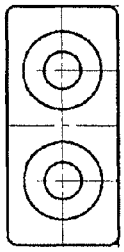

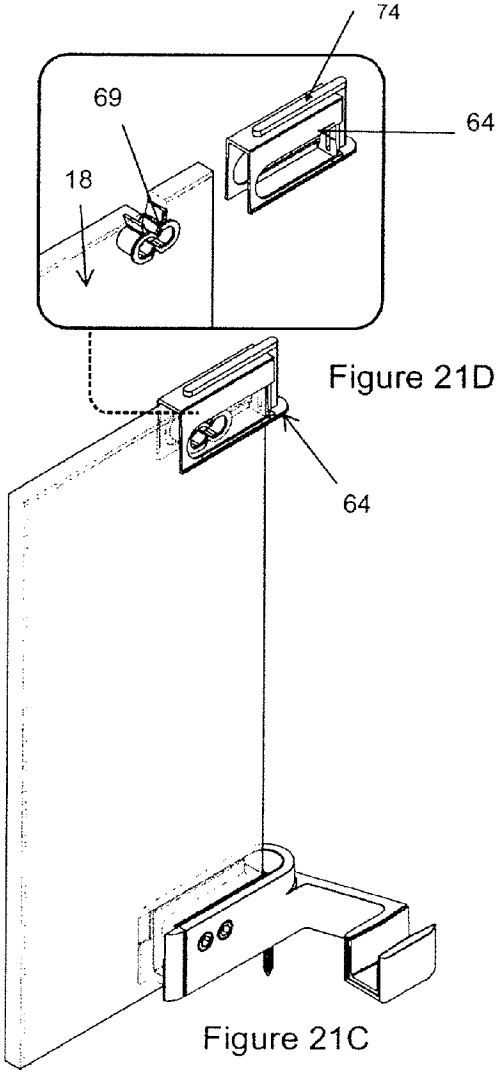
Figure 21D
Figure 21C
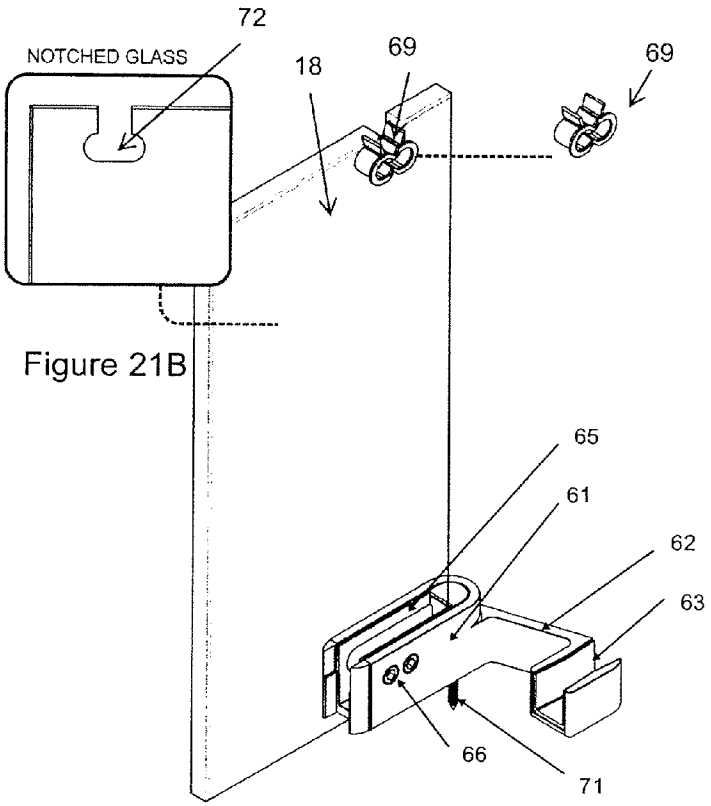
Figure 21B
Figure 21A

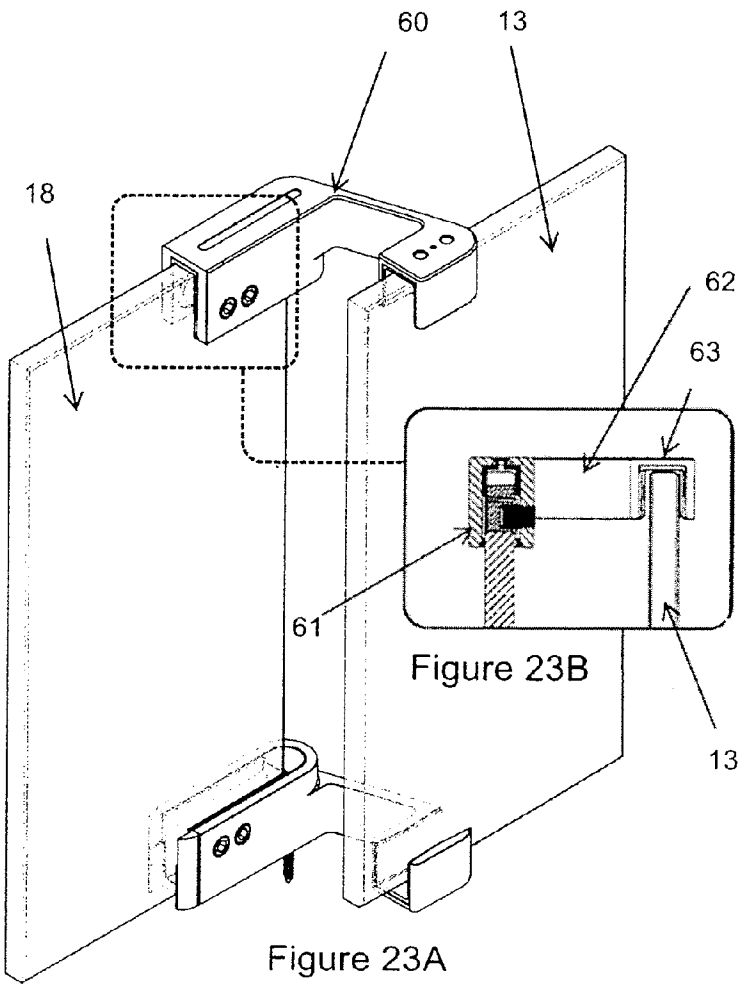
Figure 23A
Figure 23B
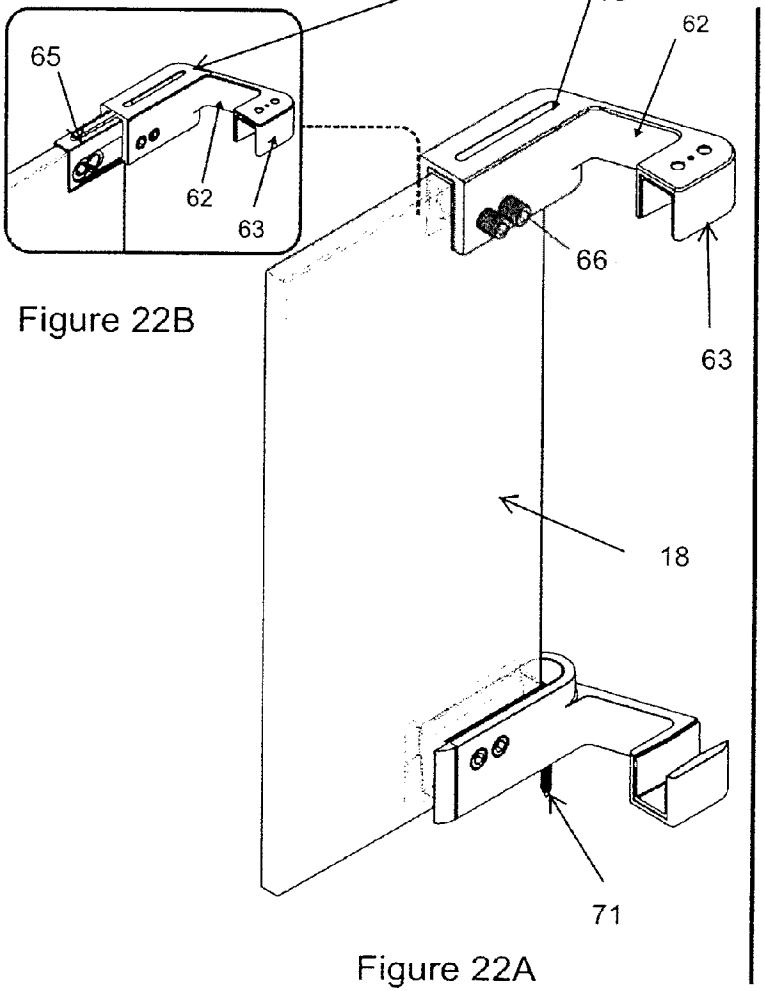
Figure 22A
Figure 22B

SLIDING DOOR STOPPER SYSTEM

FIELD OF THE INVENTION

The present invention relates generally to a stopper system for sliding door panels used in enclosures, in particular shower and tub enclosures. More specifically it relates to a stopper system for sliding door panels that are suspended from an overhead track wherein said stopper system comprises an anti-derailing component.

BACKGROUND

Sliding doors are commonly used for shower and tub enclosures, closets, room dividers, etc. A sliding door system may include one sliding door, one sliding and one stationary door, two sliding doors and any of the combinations of sliding and still doors. A typical sliding door installation is comprised of a frame enclosing two or more sliding doors movable within the frame. Roller assemblies are usually attached to the top edges of the sliding doors which ride along a track forming part of the frame. The frames are typically bulky and metallic, causing an unpleasant appeal to the eye, as well as providing a surface for soap scum to form.

With sliding door systems, there is a need to stop the motion of the sliding door to a specific position (such as an open or closed position). Different types of stoppers for stopping a sliding door running along a rail within a frame are used in the art.

Some models of sliding doors ride along a rail or track without any enclosing frame to enclose the sliding doors. The elimination of the enclosing frame provides aesthetic benefits. However, this may also create a risk of the sliding door being derailed as a result of rapid opening and/or hitting the stopper. There is a risk that upon impact with a stopper, the sliding door may "jump" or move such that the sliding door may derail. Given that some sliding doors are made of glass, are heavy and fragile, derailment of the sliding door may result in serious injury or risk of injury, as well as damage to the sliding door.

Therefore, there is a need for a sliding door stopper system, which not only stops a rapidly moving sliding door without damaging it, but also prevents the derailment of the sliding door, and in particular, should it be opened/closed with excessive force.

BRIEF SUMMARY OF THE INVENTION

The present sliding door stopper system comprises at least two members. The first member is a striker member, preferably positioned at a predetermined location on a sliding door. The second member is a stopper member, preferably positioned on a rail or rod extending between two vertical walls housing a tub or shower enclosure. The sliding door comprises at least one roller allowing the door to ride along said rail or rod. The striker member and stopper member being engageable with each other in a first position, and disengageable in a second position.

In one embodiment, the striker member comprises at least one striker, preferably two strikers separated by a body. Said striker member further comprises attachment means to attach said striker member to said sliding door or said rail or rod. Preferably said attachment means is at least one screw.

In a preferred embodiment, the striker member comprises a first body having a top, bottom, two sides and two ends;

a second body, having a top, bottom, two sides and two ends;

connecting means to connect said first body to said second body;

at least one striker proximate at least one end of said first body; preferably said striker member comprises at least one striker proximate each end of said first body.

In another embodiment, the stopper member comprises a body, having at least two ends;

connecting means to connect said stopper member to said sliding door or said rail or rod, preferably rod or rail connecting means to connect said stopper member to said rod or rail, preferably said rod or rail connecting means is an aperture in said stopper member to receive said rod or rail; in another embodiment, said stopper member is integral with said rod or rail;

striker receiving means, to receive said at least one striker; preferably a striker slot;

at least one bumper proximate one of said at least two ends; to absorb the force of said sliding door when said striker member makes contact with said stopper member.

Preferably said stopper member is attached to a rod at a predetermined location, said rod preferably spanning the width of a tub or shower enclosure. Preferably said striker member is attached to a sliding door at a predetermined location, to allow said striker member to engage with said stopper member at a predetermined position along said rod.

Preferably said sliding door has at least one roller attached thereto to allow said sliding door to move along said rod, preferably said sliding door slides or rolls along said rod, preferably said sliding door has at least two rollers attached thereto.

The sliding door stopper assembly allows the sliding door to be removed from the rod, when required, while preventing the sliding door from derailing when in use.

According to one embodiment there is provided a sliding door assembly for use with a tub or shower enclosure, said assembly having: a rod, having a first end and a second end extending along said enclosure; at least one door, having a top, bottom, first end, second end, first surface and second surface; at least one roller attached to said door at a predetermined position and slidably engaging said rod; a stopper attached to said rod, at a predetermined position; a striker attached to said door, at a predetermined position. Said striker further comprising at least one striking member; said stopper further comprising at least one striking member receiver. Wherein when said door is in a first position, said at least one striking member and said at least one striking member receiver are not engaged and when said door is in a second position, said at least one striking member and said at least one striking member receiver are engaged, preventing said at least one door from substantial horizontal and vertical movement along said rod.

Preferably the stopper further comprises a bumper.

Preferably, said striker is attached to said door proximate said at least one roller.

Preferably the door has at least two rollers proximate the top thereof.

According to yet another aspect of the invention there is provided a stopper member for a sliding door supported on a substantially horizontal rod, said stopper member having a body with an aperture to receive said rod; at least one bumper attached to said body; and a slot to receive a striker member attached to the sliding door, for preventing said door from substantial vertical and substantial horizontal movement.

According to still another aspect of the invention there is provided a striker member attached to the sliding door, supported on a rod, said striker member has a striking surface to meet the bumper of the stopper member described above and at least one wing for engagement with said slot.

According to still another aspect of the invention, there is provided a sliding door security system, said system having: At least one sliding door supported on a rod. A striker member attached to the door, said striker member comprising at least one wing, and a stopper member attached to the rod, said stopper member comprises a slot to receive the wing of the striker member. Wherein contact between the striker and the stopper prevents substantial motion of the door.

Preferably, in said sliding door security system, the wing of the striker member is at least partially inserted through the slot of the stopper member upon contact. More preferably, the stopper member further comprises a bumper member.

More preferably, the contact between the wing of the striker member and the slot of the stopper member substantially limits the vertical movement of the sliding door.

According to another aspect of the invention, there is further provided at least one anti jump sliding bracket, preferably a pair of anti jump sliding brackets.

Further aspects of the invention will be apparent from the following disclosure, illustrations and claims.

BRIEF DESCRIPTION OF THE DRAWINGS

FIG. 1' is a schematic illustration of the relative positions of the striker, stopper and the door roller in a further embodiment.

FIG. 2' illustrates the front and back views of the stopper in a further embodiment.

FIG. 4' illustrates the motion on the door read the striker prior to impact in a further embodiment.

FIG. 5' illustrates the front view of the striker/stopper after the impact in a further embodiment.

FIG. 6' illustrates the side view of the striker/stopper after the impact in a further embodiment.

FIG. 7' illustrates the maximum of vertical motion of the door after the impact in a further embodiment.

FIGS. 8 A'-E' illustrate the stopper with the bumper from isometric, top, front, side and a cross-sectional side view in a further embodiment.

FIGS. 9 A-E illustrates various views of the stopper without the bumper.

FIGS. 10 A'-E' illustrate various views of the bumper element in a further embodiment.

FIGS. 13 A-C, 14 A-C, and 15 A-C illustrate additional parts of the striker.

FIGS. 21 A-D, 22 A-B, 23 A-B, and 24 A-B illustrate the installation of the supplementary sliding brackets in another embodiment of the invention.

DETAILED DESCRIPTION

Figure 1:
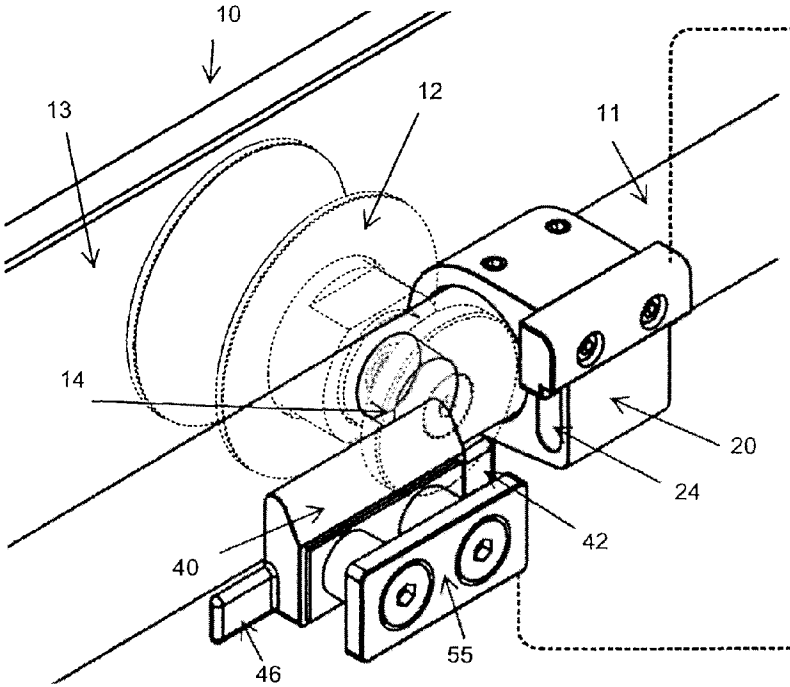
FIG. 1 is a schematic illustration of the relative positions of the striker, stopper and the door roller.
Figures 1, 2:
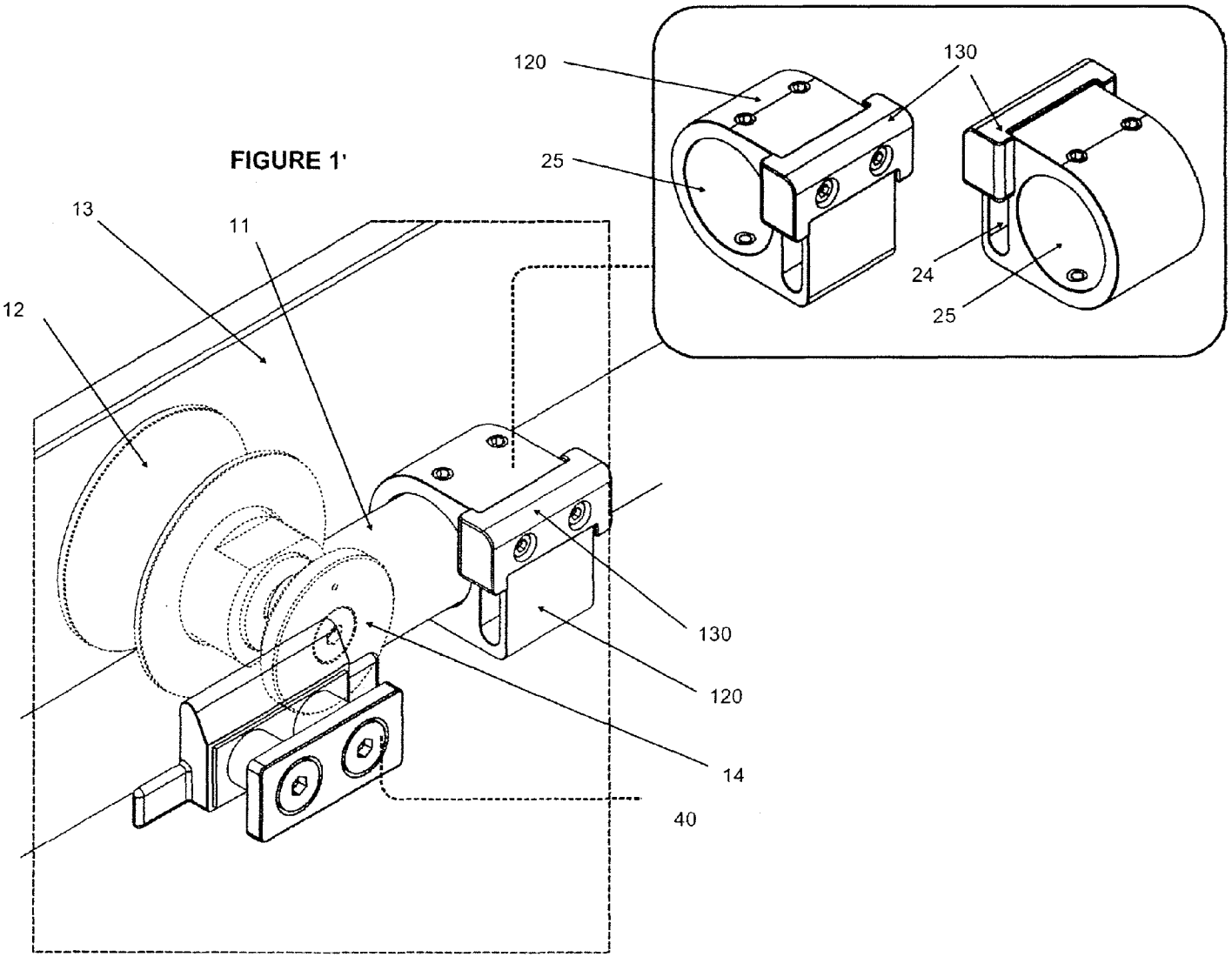

Referring now to FIG. 1, a sliding door stopper system 10 is shown. Sliding door 13, made of tempered glass, has a wheel or roller 12 allowing it to ride along rod 11. Although sliding door 13 has one roller 12 proximate one end of the sliding door 13, preferably said sliding door 13 will have another roller 12, proximate the other end of the sliding door 13, distant said first roller 12. The number of rollers 12 on said sliding door 13 may depend upon the weight and/or length of the sliding door 13. Roller 12 may be attached to the sliding door 13 by means known in the art. In this instance, the roller 12 is attached to the sliding door 13 by attachment member 14. Rod 11 provides a surface for the sliding door 13 to move along via the roller 12, from an open position to a closed position, and any position between, and supports the sliding door 13. The rod 11 has attached thereto, stopper 20. The stopper 20 prevents the sliding motion of the sliding door 13 beyond a predetermined point along said rod 11 as best illustrated in FIGS. 5, 7, 17-20.

Figure 2:
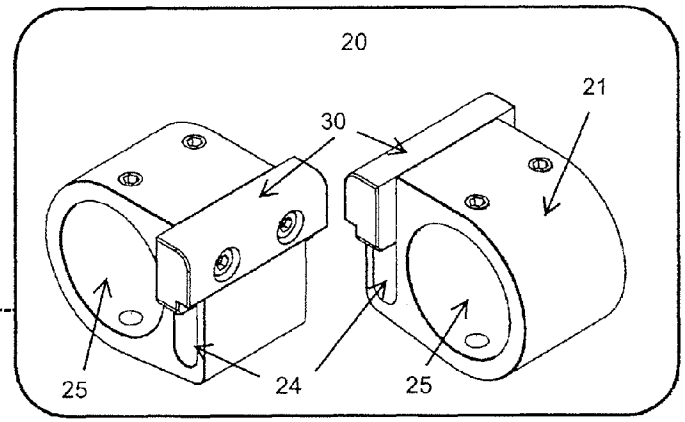
FIG. 2 illustrates the front and back views of the stopper.
Figure 3:
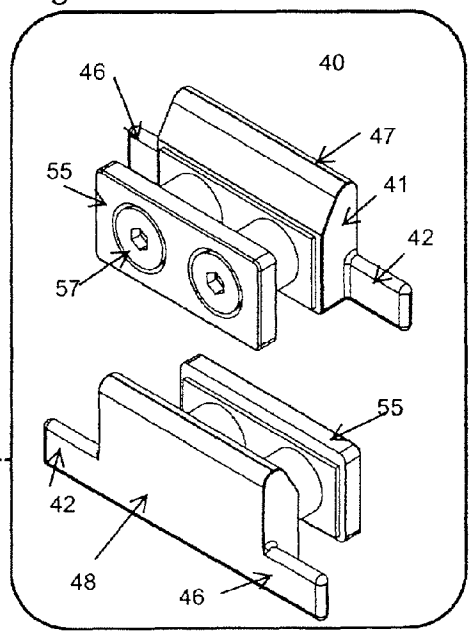
FIG. 3 illustrates the front and back view of the striker.

Referring now to FIGS. 1-3, proximate roller 12 on said sliding door 13, there is provided a striker 40. Striker 40 is attached to sliding door 13, by any means known in the art; in this instance, by means of outer plate 55.

FIG. 2 illustrates a front and back view of stopper 20. Stopper 20 comprises a body 21 and rod receiving aperture 25, a bumper 30 and a striker wing (42 and 46 as best seen in FIG. 3) receiving slot 24.

FIG. 3 illustrates a front and back view of striker 40. Striker 40 has a body 47, with two ends, two wings 42 and 46, one wing proximate one end and the other wing proximate the other end and attachment means to attach striker 40 to sliding door 13. In this instance, said attachment means comprises an outer plate 55, and a pair of screws 57.

As can be seen in FIGS. 1' and 2', bumper 130 in a further embodiment has a modified body to fit stopper 120. Although the bumper 130 has a modified body, it functions similarly to the bumper 30 of FIGS. 1 and 2.

FIGS. 4-7 illustrate the action of striker 40 and stopper 20 during the sliding motion of the sliding door 13 along the rod 11.

As sliding door 13 is moving toward stopper 20, it can be seen that each wing (42 and 46) on striker 40 is positioned on the same side of sliding door 13 as roller 12 and stopper 20, while outer plate 55 and roller bracket 14 are located on the opposite side of sliding door 13.

Figure 5:
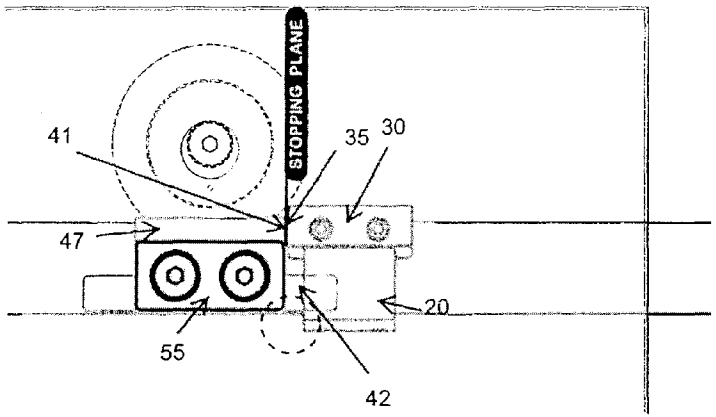
FIG. 5 illustrates the front view of the striker/stopper after the impact.

FIG. 5 illustrates the moment of contact between striker 40 and stopper 20. In a preferred embodiment the impact takes place between side wall 41 of striker 40 and bumper face 35 of the bumper 30 attached to the stopper 20. Preferably, when the striker 40 contacts the bumper 30, there is no contact between the roller 12 and the stopper 20.

Figure 6:
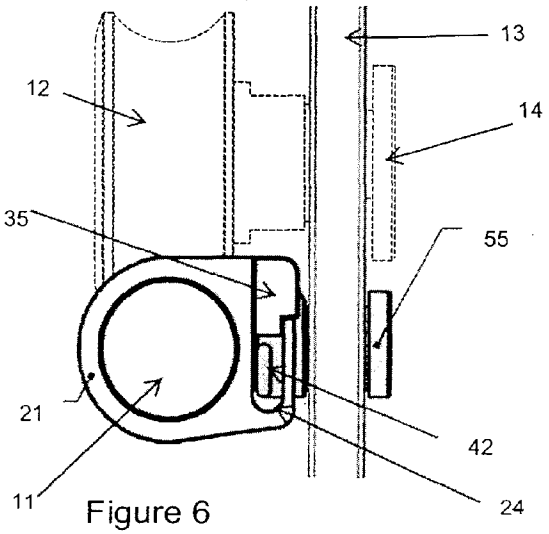
FIG. 6 illustrates the side view of the striker/stopper after the impact.
Figure 7:
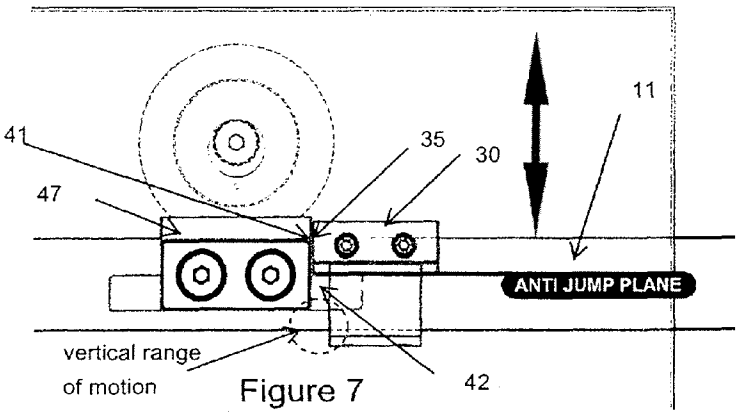
FIG. 7 illustrates the maximum of vertical motion of the door after the impact.
Figure 4:
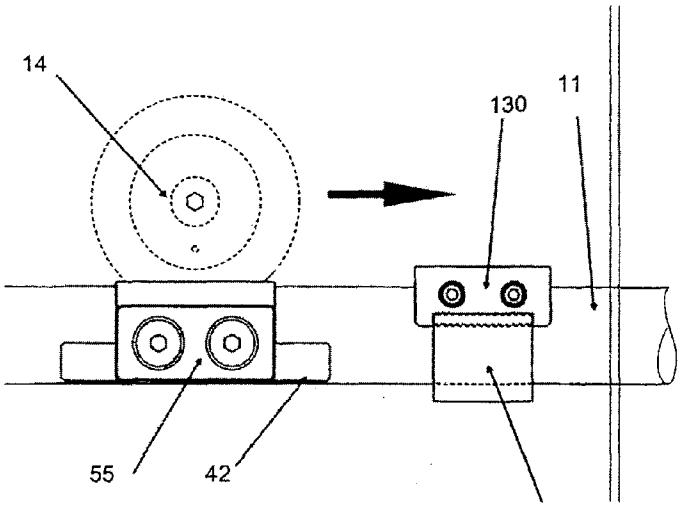
Figure 5:
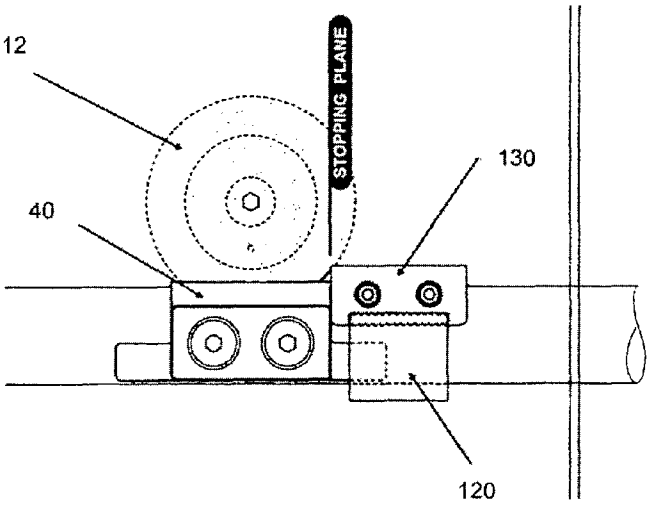
Figure 6:
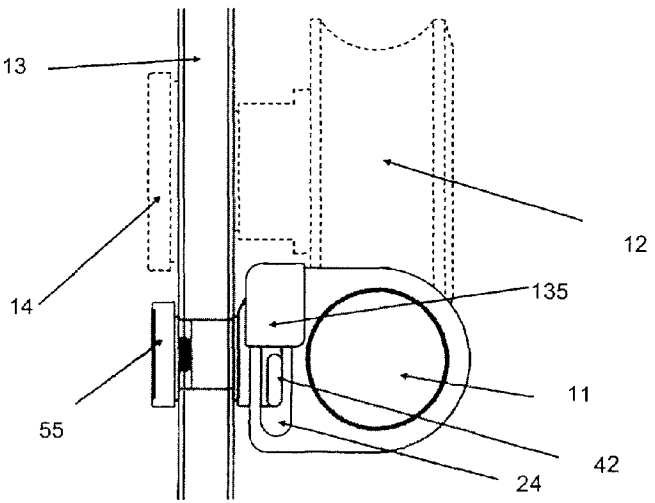
Figure 7:
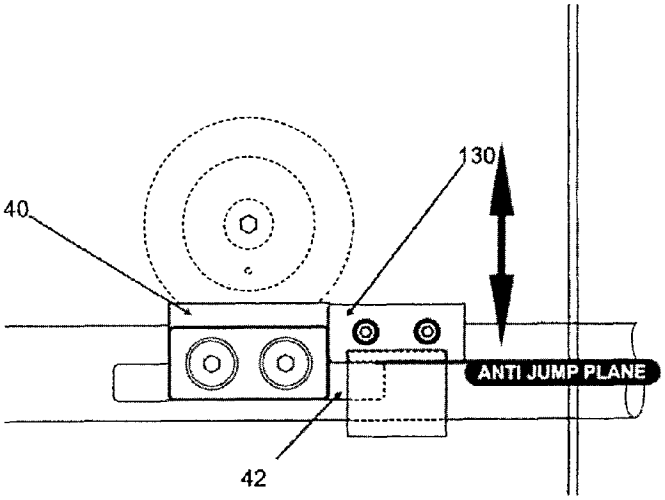

At the end of the sliding motion of sliding door 13 along rod 11, wing 42 engages slot 24 of stopper 20 (best illustrated in FIGS. 5-7). The engagement of wing 42 in slot 24 not only prevents further sliding motion of the sliding door 13 along said rod 11 (stopping plane in FIG. 5), but also limits motion of sliding door 13 in a substantially vertical direction (anti jump plane in FIG. 7), therefore, preventing the vertical dislocation or derailment of the sliding door 13 from the rod 11.

Therefore, even if sliding door 13 was pushed with excessive force toward the stopper 20, it would not be dislocated from the rod 11, once wing 42 is engaged with slot 24 (see vertical range of motion marked in FIG. 7). Contrary to the prior art wherein without the system of the present invention, the sliding door 13 may jump rod 11 and become disengaged from rod 11, potentially causing harm to the user and damage to the sliding door 13.

Figure 4:
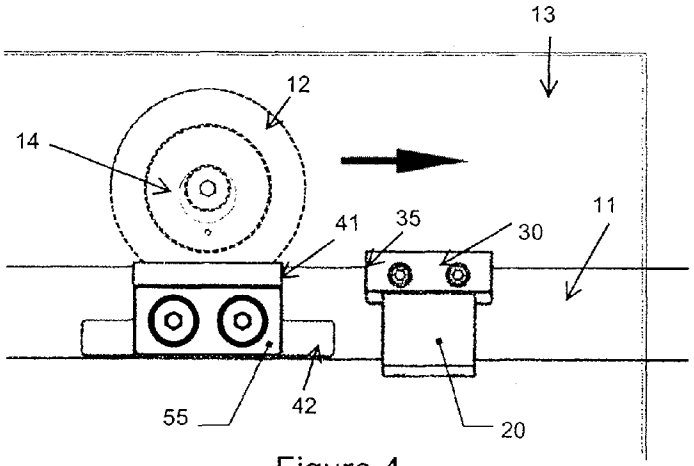
FIG. 4 illustrates the motion on the door read the striker prior to impact.

Similarly FIGS. 4'-7' show the action of the striker 40 and stopper 120 with bumper 130.

Now referring to FIGS. 8A-8E and 9A-9E, FIG. 8A illustrates an isometric exploded view of stopper 20. Stopper 20 comprises a body 21, a vertical front wall 22, a bumper barrier wall 23, bumper 30, and a slot 24. Slot 24 is defined by the space created between vertical front wall 22, bumper barrier wall 23 and bumper 30. The stopper 20 further comprises a rod receiving aperture 25 to receive rod 11. Aperture 25 also allows positioning of the stopper 20 along rod 11 supporting the sliding door 13.

Preferably, the stopper 20 is made of material suitable for the environment of use, in this instance, shower or tub environments. Preferably the material is metal such as aluminum, stainless steel; zinc alloy, brass or other strong materials (e.g. plastics and/or polymers) may be used to manufacture the stopper 20. Preferably, the stopper 20 is made as a single unitary piece, but also can be made from a plurality of pieces. If the stopper 20 is made as a single piece, preferably, it (or two stoppers) should be positioned on the rod 11 prior to the installation of the rod 11 between the walls defining a shower or tub enclosure. In an alternative embodiment (not shown), the stopper 20 can be made of two or more pieces. In this instance, the stopper 20 (or two stoppers) can be attached to the rod 11 after its installation between the walls defining a shower or tub enclosure.

Figure 8C:
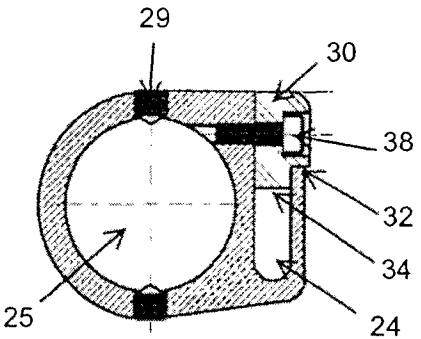
FIGS. 8 A-E illustrate the stopper with the bumper from isometric, top, front, side and a cross-sectional side view.
Figure 8E:
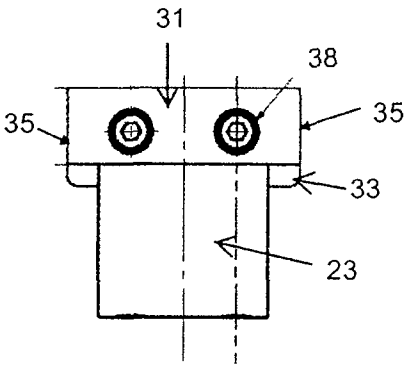
Figure 8B:
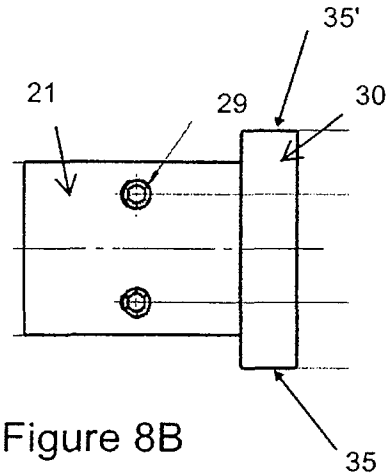
Figure 8D:
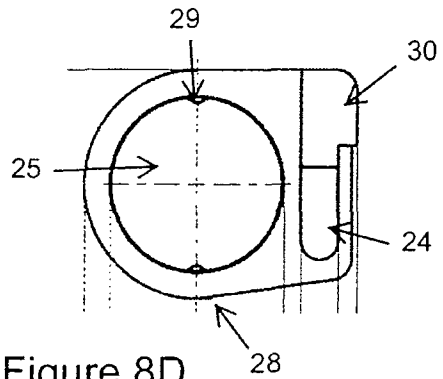
Figure 8A:
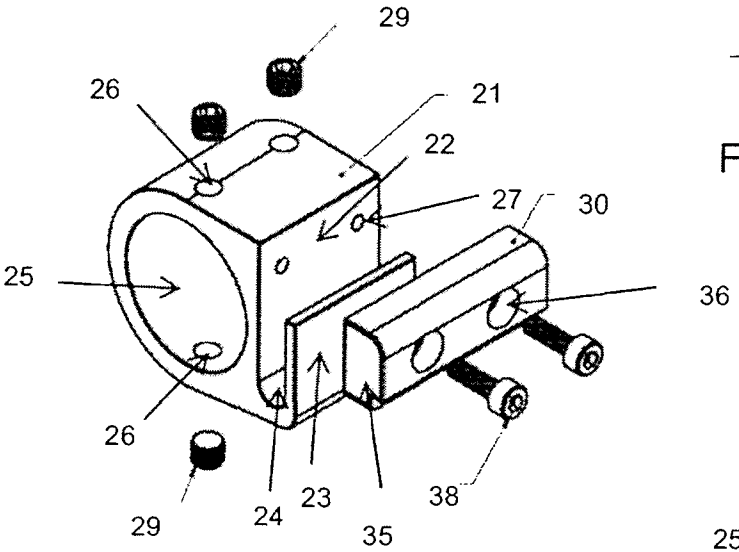
Figure 8C:
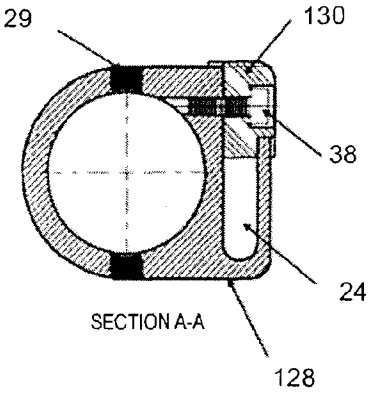
Figure 8E:
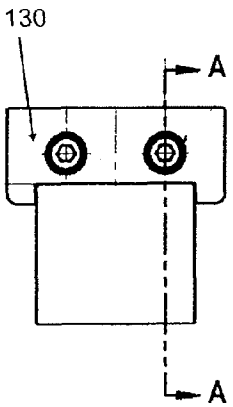
Figure 8B:
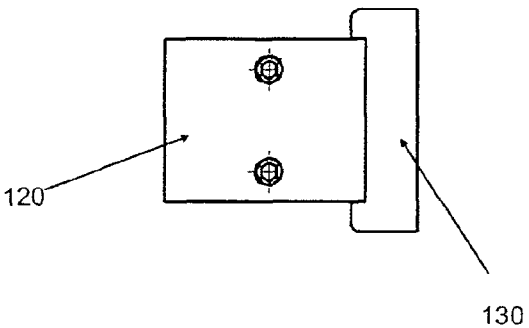
Figure 8D:
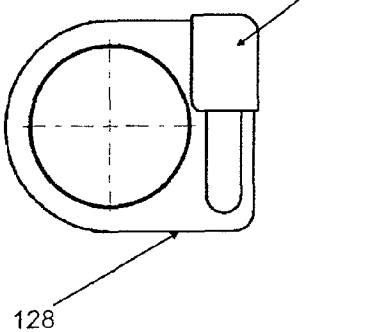
Figure 8A:
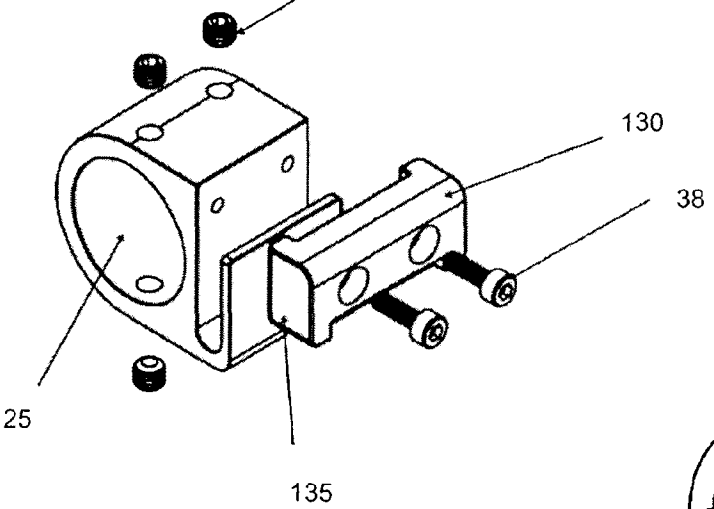

Stopper 20 is attached to rod 11 by fasteners 29, in this instance a series of headless screws, also known as set screws, inserted through the stopper body 21 at screw holes 26, best illustrated in FIG. 8A. As illustrated in FIGS. 8A-E, there are four fasteners 29 to secure stopper 20 along rod 11. However, the number of fasteners can depend on the design of stopper 20 and rod 11. In alternative embodiments, stopper 20 may be attached to rod 11 by pressure, friction, mechanical or other means known in the art. In another embodiment (not shown), the stopper 20 (or at least two stoppers) is pre-formed at predetermined locations along rod 11 and thus is unitary with rod 11.

Similarly FIGS. 8A'-E' illustrate the stopper 120 and bumper 130 when disassembled and assembled. As can be seen, when compared with stopper 20, stopper 120 is not tapered towards wall 32 (FIG. 8C') but the bottom 128 is parallel to the top of bumper 130. Bumper 130 has a full side face 135 rather than a partial side face 35 as bumper 30. This embodiment allows a tighter engagement of the bumper 130 with the stopper 120.

FIGS. 10A-E illustrate an isometric, a front, side and a cross-sectional view of the bumper 30 depicting the fastener receiving apertures 36. Although in this instance the bumper 30 is removable from the stopper 20 in order to replace a worn down bumper, it can also be incorporated within the body of the stopper 20. The bumper 30 may also comprise a permanent non-resilient portion and a removable resilient portion. In this manner the resilient portion may be replaced after being worn or damaged from prolonged usage.

Bumper 30 is made of material in order to withstand multiple impacts with the striker 40. In one instance, the bumper 30 is made of natural or synthetic rubber such as polyurethane rubber or other synthetic materials known in the art. Any strong and resilient material that allows for multiple impacts while maintaining its integrity over a substantial period of time is preferred. The bumper 30 has a body 31 with back 37 attached to the stopper main body 22 by fasteners 38. In this instance a set of socket head cap screws 38 through holes 36 and into the body of the stopper through body screw holes 27 allow attachment. Bumper 30 has two ends 35, 35' which extend beyond the sides of stopper 20, in order to receive the full impact of striker 40 (best illustrated in FIGS. 8B and 8E). Preferably, bumper 30 has a bottom plane 34 (see FIGS. 10B, 10C and 10E); in this case, the plane 34 is positioned on top of the bumper barrier 23 and acts as a top surface for slot 24 which prevents wing 42 and in turn sliding door 13 to move in an unwanted upward motion. In a preferred embodiment the bumper 30 has a lip 32 with a step 33 to wrap around the wall 23 of the stopper. However other designs of the bumper and way of its attachment known in the art can be used.

Figure 10A:
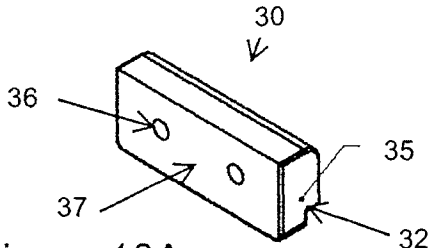
FIGS. 10 A-E illustrate various views of the bumper element.
Figure 10B:
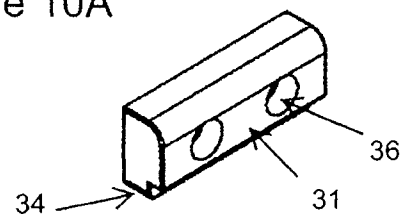
Figure 10D:
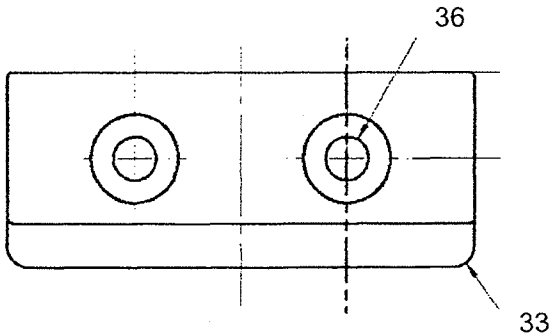
Figure 10E:
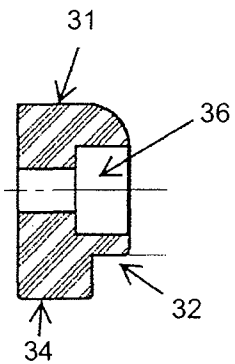
Figure 10C:
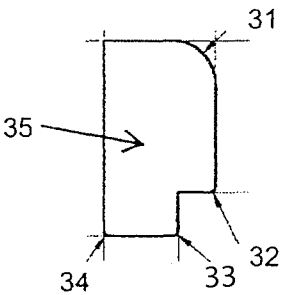
Figure 10A:
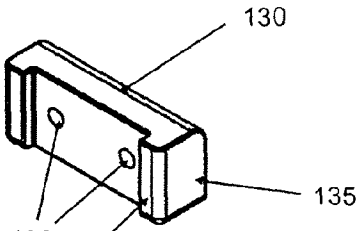
Figure 10B:
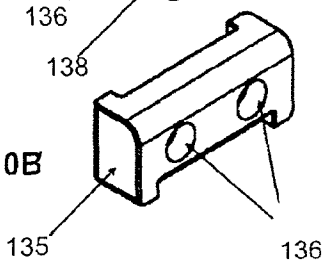
Figure 10D:
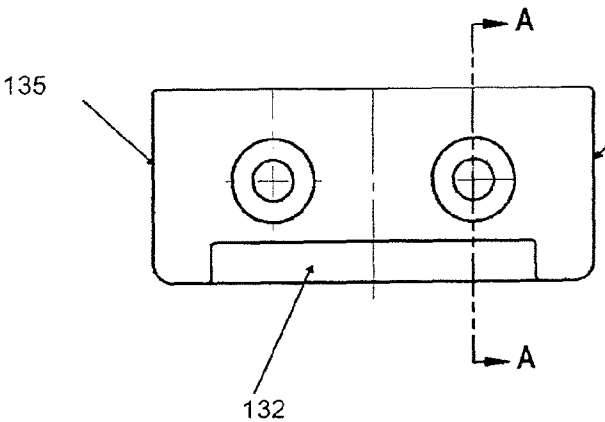
Figure 10E:
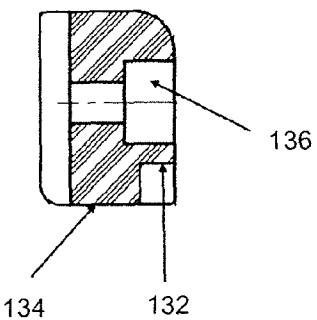
Figure 10C:
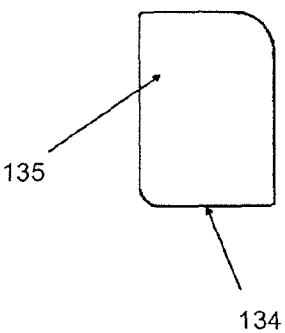
Figures 11A, 11B, 11C, 11D:
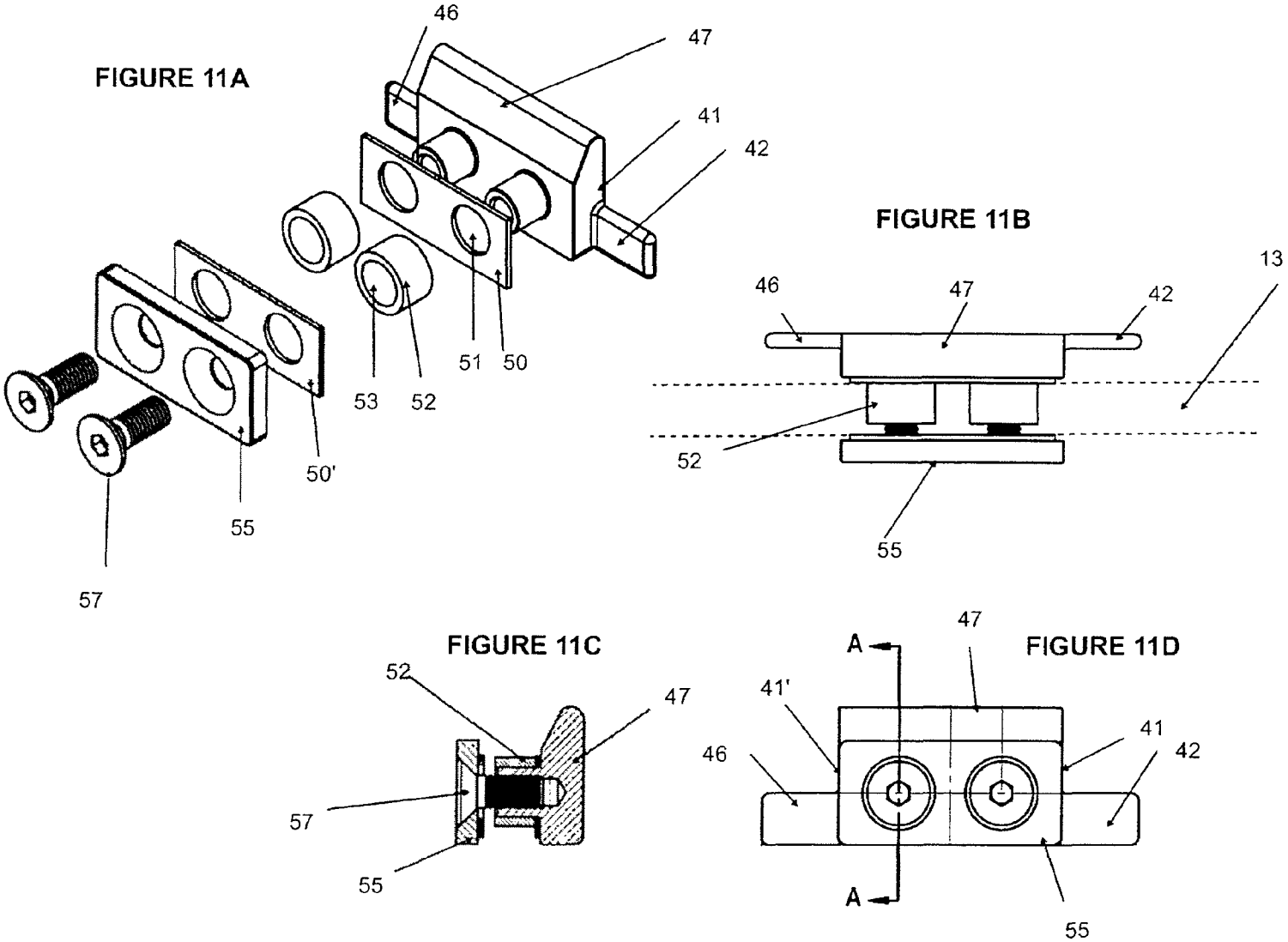
FIGS. 11 A-D illustrate various views of the striker with its outer plate.
Figure 12A:
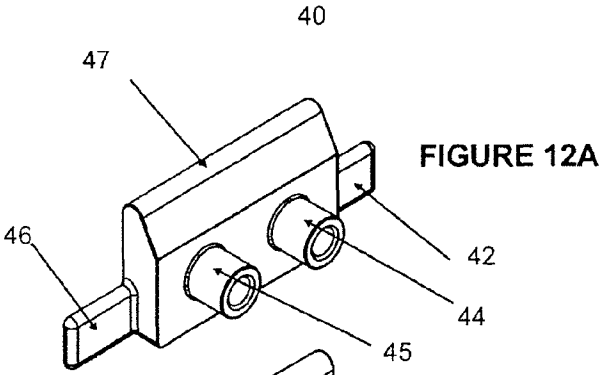
FIGS. 12 A-E illustrate various views of the striker without the outer plate.
Figure 12B:
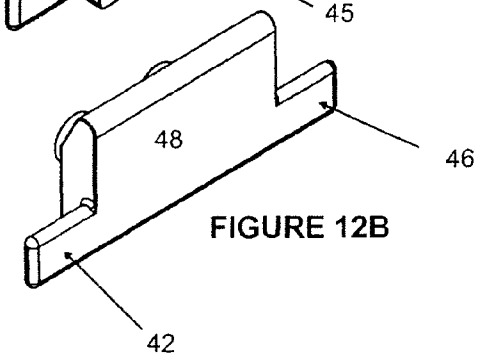
Figure 12C:
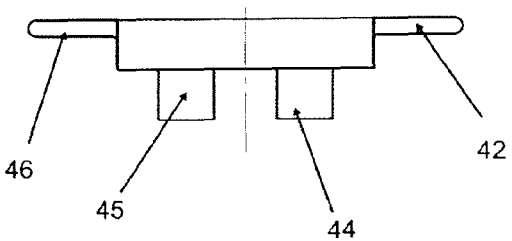
Figure 12D:
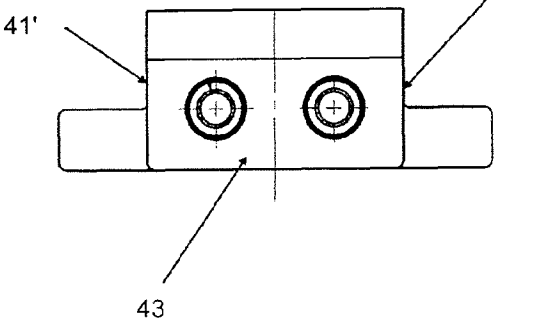
Figure 12E:
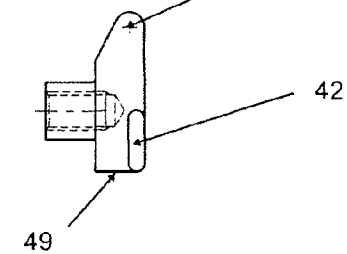

As can be seen in FIGS. 10A'-10E', the bumper 130 in the further embodiment has side walls 135 and a full bottom lip 134 as compared to the bumper 30 of FIGS. 10A-10E with a partial side wall 35 and a partial bottom plane 34.

FIGS. 11A-D and 12A-E illustrate an exploded, top, side cross sectional and front view of the striker 40. The striker 40 may be made of the same material as a stopper 20 such as hard plastic, polymer, metal or composite material, preferably stainless steel or other material appropriate for the shower and/or tub environment. Since there are a plurality of ways of attaching hardware to sliding doors the following embodiment provides only one example, which is not in a limiting sense. In a preferred embodiment, the striker 40 is attached to the sliding door with an outer plate 55 with screws 57.

The striker 40 has a top 47 a bottom 49 two sides 41, 41', two wings 42 and 46 extending perpendicular to the walls 41 and 41' respectively, front 43 and back 48. Front 43 of the striker 40 comprises fastening receiving members 44 and 45, which are provided to receive fastening members 57 attaching the striker 40 to the sliding door by the means of the outer plate 55. This can best be seen in FIG. 11B which provides an overhead view of the striker 40 when attached to the sliding door 13. The wings 42 and 46 are designed to easily enter into slot 24 of the stopper 20. The size and the geometrical form of the wings are adapted to enter and exit the slots 24 without friction. Alternatively, the wings 42 and 46 may be adapted to be locked in place, once inside the slot 24 of stopper 20, or to act to slow the movement of the sliding door toward the stopper 20.

In a preferred embodiment, padding 50 with apertures 51 is positioned between the striker body and one side of the sliding door, and padding 50' positioned between the outer plate 55 and the other side of the sliding door, to prevent direct contact between components of the striker and the sliding door, for instance if the sliding door is made of glass. The padding 50 and 50', best illustrated in FIGS. 11A and 14A-C, may be made of any material that exhibits padding like qualities, for example, rubber or polymers such as polypropylene, polyvinyl chloride ("PVC") or Thermoplastic polyurethane ("TPU"). Connecting members 44 and 45 are covered with sleeves 52 to minimize direct contact with the sliding door if made of glass. This also reduces any damage to the apertures in the sliding door and sleeves 52 best illustrated in FIGS. 13A-C can be made of plastic material such as polypropylene or other material acceptable in the art. Sleeves 52 each comprise an inner void 53 to fit over connecting members 44 and 45, preferably said sleeves 52 are substantially tight fitting over members 44 and 45.

Outer plate 55 with apertures 56 is provided to guide fasteners 57 when assembling the striker 40 and to provide a flush surface with fasteners 57 when the striker 40 is assembled. Sleeves 52 further protect contact between fasteners 57 and sliding door 13. Outer plate 55 is preferably made of metal such as stainless steel, aluminum, zinc alloy, and engineered plastic.

Some of the examples discussed used of the stopper and striker with a glass door running along a rod, but the invention may be used with any type of sliding door and supporting structure other than a rod. For example, in case of a wooden sliding door there is no need to use outer plate 55 since the striker 40 may be attached directly to a wooden sliding door by means known in the art.

In a preferred embodiment, roller 12 is adjustable. Preferably roller 12 is adjustable in at least one direction. Most preferably roller 12 is adjustable is a substantially vertical direction, to allow for alignment of wing 42 into slot 24. The adjustability of roller 12 may be in the form of an elongated slot in the sliding door, or within the roller 12 itself.

Furthermore, although in the examples, the rod is shown proximate the top of the sliding door, the rod may be positioned as preferred by the user to allow the sliding door assembly to function as needed.

Figure 16C:
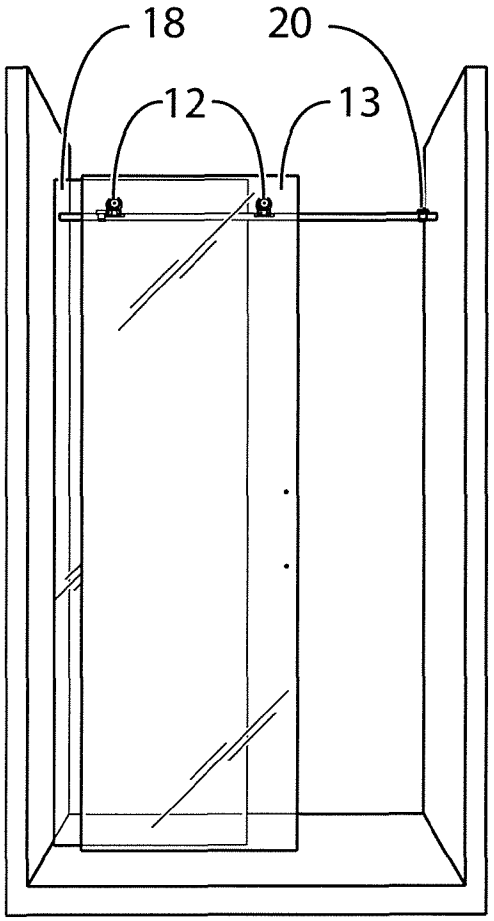
FIGS. 16 A-C, 17 and 18 illustrate an example of a sliding door system of the present invention with one sliding door in various positions in a shower enclosure.
Figure 16B:
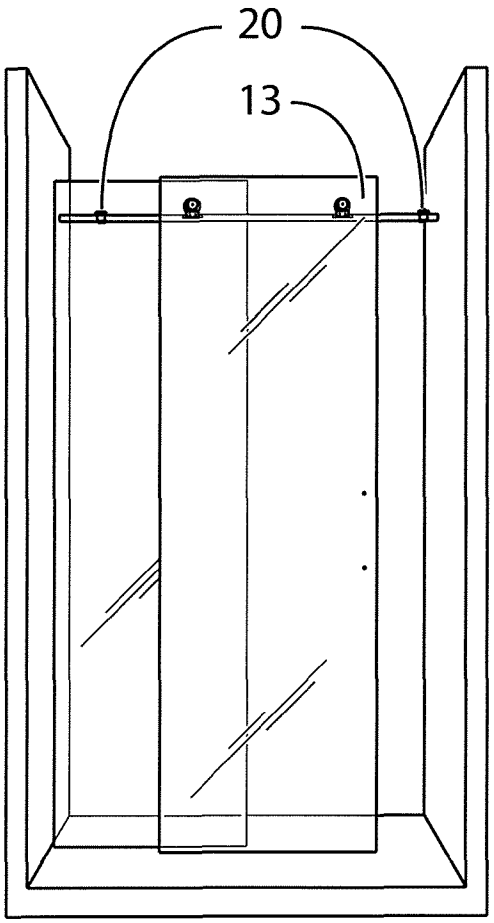
Figure 16A:
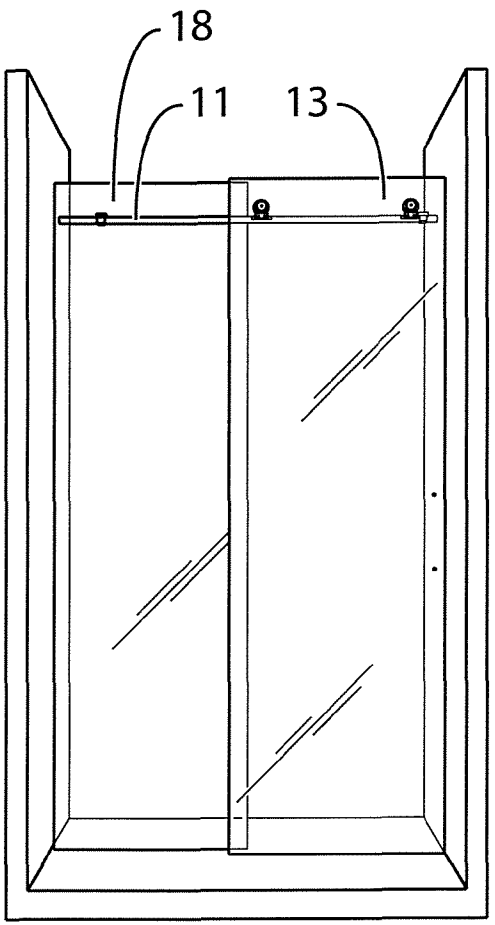
Figure 17:
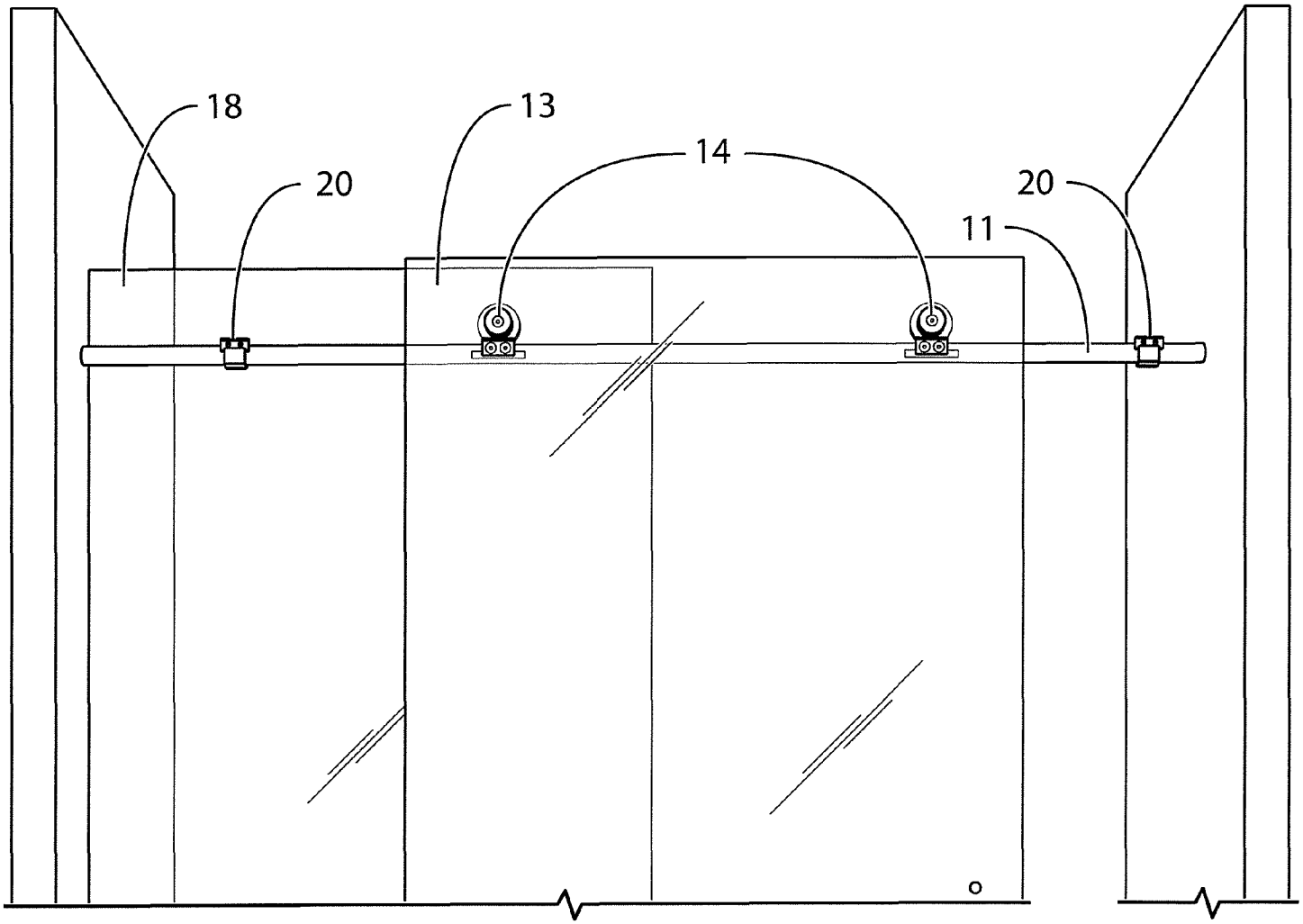
Figure 18:
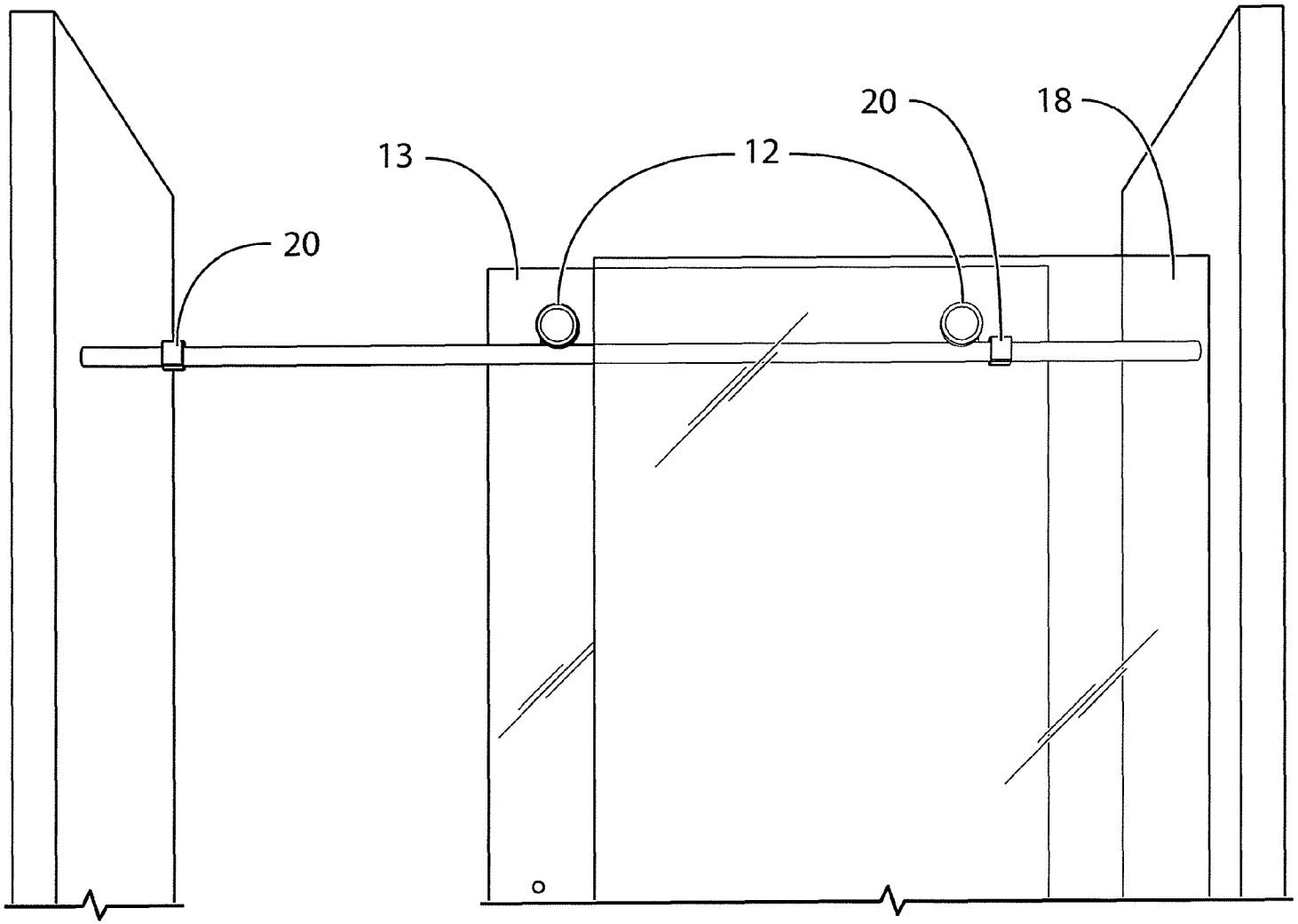

FIGS. 16-18 illustrate one example of a sliding door 13 along with a stationary door 18 in a shower enclosure formed by two walls. In this example the door 13 is equipped with two rollers 12, each one proximate each side edge of the door 13, and the rod 11, situated between the enclosure formed by the two walls has two stoppers 20, each stopper situated near each end of the rod 11. FIGS. 16A-C illustrate the position of the sliding door 13 in three stages. Fully closed is depicted in FIG. 16A, fully open in FIG. 16C and intermediate in FIG. 16B. FIG. 17 further shows a close-up back view of the sliding door in an intermediate position of FIG. 16B. Finally FIG. 18 shows a close-up from the front of the fully open sliding door of FIG. 16C.

In another embodiment, the bumper member may be attached to the striker member instead of being attached to the stopper member.

In an alternative embodiment of the invention, the sliding door stopper system further comprises an anti-jump sliding bracket 60. As best illustrated in FIGS. 19, 20, 21 and 22 the bracket 60 is attached to a stationary door 18 and also slidably attached to a sliding door 13. Bracket 60 further aids in substantially minimizing any substantial vertical motion of sliding door 13. Bracket 60 may be attached to door 18 by any means known in the art, preferably via detachable means, such as by screws or other fasteners. In an alternative embodiment the bracket 60 may be fixed to the sliding door 13 and slidably attached to the fixed door 18 (not shown).

Bracket 60 as best illustrated in FIGS. 21-25 comprises: a stationary door attachment means, preferably a fixed channel 61 and proximate thereof a slidable door attachment means, preferably a sliding channel 63. Preferably said stationary door attachment means is attached to said slidable door attachment means via a bridge portion 62. The fixed channel 61 is preferably attached to one of the doors by screws 66. Preferably the fixed channel 61 is lined with a liner 64 or 65. In the same manner the sliding channel 63 may also be lined with a liner 67 or 68. The liners 64, 65, 67 and 68 serve to aid in securing the bracket onto the door as well as protect the door from direct contact with the bracket 60.

Figure 19:
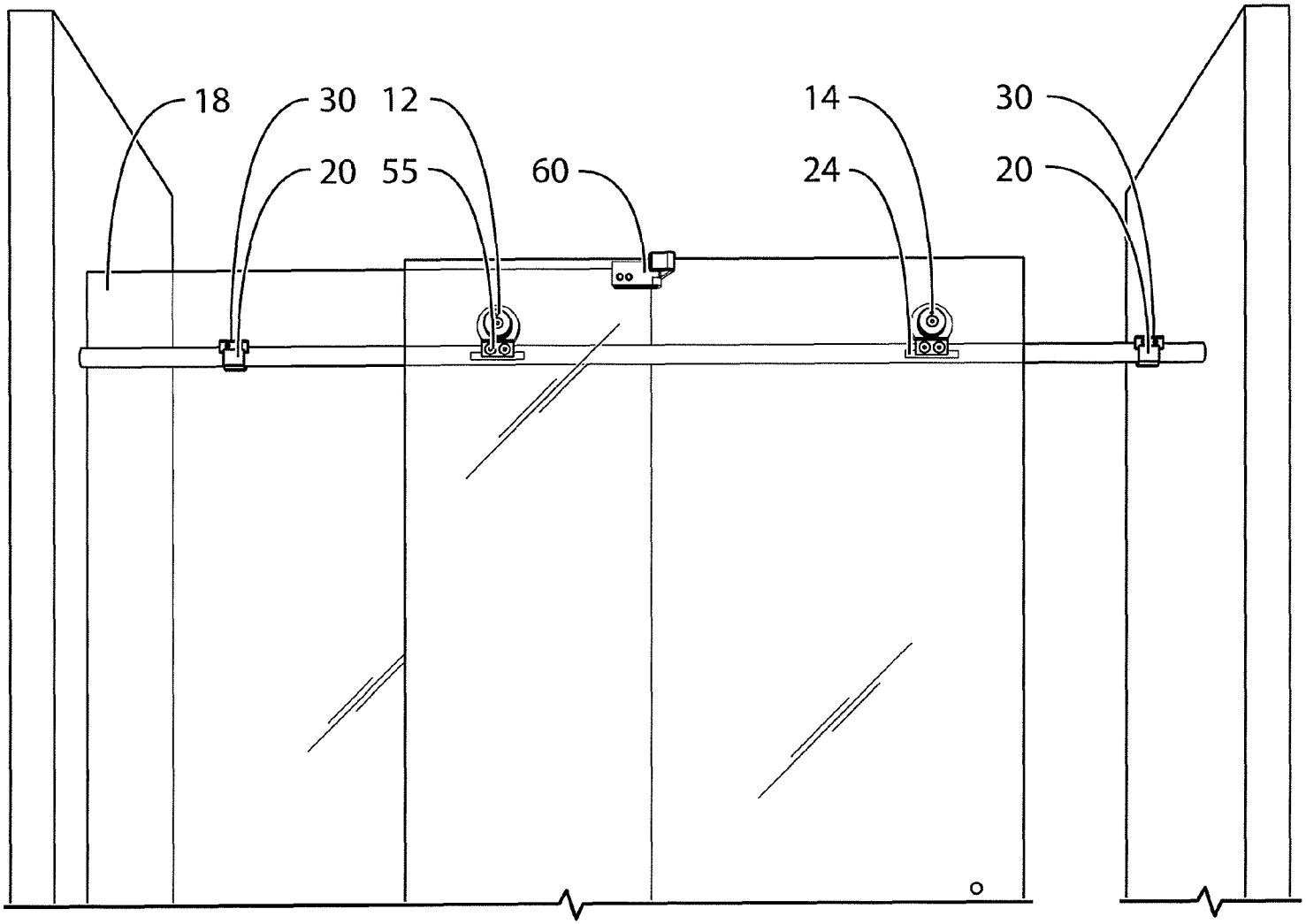
FIGS. 19 and 20 illustrate another embodiment of the invention further comprising a supplementary sliding bracket.
Figure 20:
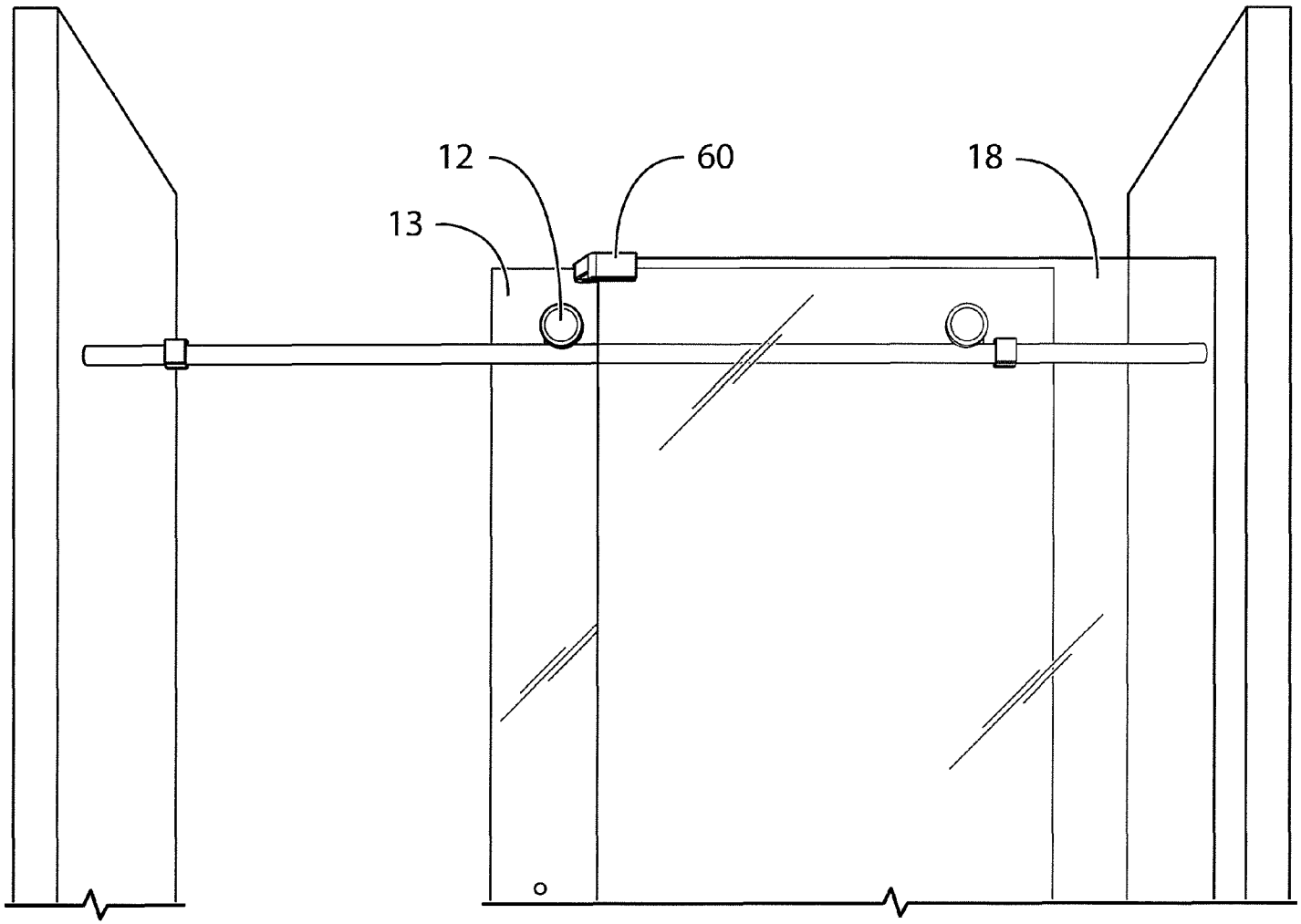

As best seen in FIGS. 19 and 20, only a top bracket is used. In this case, the bottom part of the sliding door may be supported by any means known in the art. Several examples include, but are not limited to positioning the door in a sliding channel, supported on wheels, bars, or left free hanging. Each sliding door may comprise one or two striking members. Also the sliding door system may comprise one or two stopping members and bumper members positioned accordingly to the door designs. However, the preferred embodiment is the inclusion of a top anti jump sliding bracket and a bottom anti jump sliding bracket on the doors.

In an embodiment illustrated in FIGS. 21-24 both top and bottom anti-jump sliding brackets are incorporated in the sliding door stopper system to further assist in guiding and preventing disengagement of the sliding door 13 from the enclosure during use.

As best illustrated in FIGS. 24 A-B, a pair of brackets 60A and 60B can be used at the top of the door and also at the bottom of the door, respectively. Referring back to FIGS. 21 A-D and 22 A-D, a typical installation of the brackets to one of the doors is illustrated. As can be seen, the bottom bracket 60B is further fixed by means of screw 71 to the floor, frame of the enclosure or other bottom support. The screw 71, once fastened, may be concealed in the bracket by a decorative cap 70 (as seen in FIG. 25 A). Liner 65 is placed on the lower corner of the door 18 and bracket 60B is then slid onto liner 65. Bracket 60B is then further secured to door 18 by means of screws 66.

FIGS. 21 A-D and 22 A-D illustrate one of the ways of attaching top bracket 60A to the top of door 18. In this case the door—preferably the fixed door has a notch 72 in the glass door 18. This notch is then lined with a liner 69 which then receives liner 64 prior to introducing bracket 60A. Upon the introduction of bracket 60A, screws 66 are used to further connect bracket 60A to door 18. In this case, screws 66 run through the apertures of liner 69 further securing the bracket 60A to door 18, whilst protecting the glass door 18 from damage. Other methods of attaching brackets to the doors can be also utilized without the use of a notch or otherwise.

Sliding door 13 (preferably supported on the rod 11 with rollers 12 not shown here) may then be introduced to the enclosure as best seen in FIGS. 23 A and B Sliding door 13 slides along the channel 63 of brackets 60A and 60B. Channel 63 of bracket 60A further comprises liner 67 and channel 63 of bracket 60B further comprises liner 68. The liners 67 and 68 serve to assist the glass door 13 to slide along the channel while protecting the glass door 13 from damage, such as frictional damage.

Figure 24B:
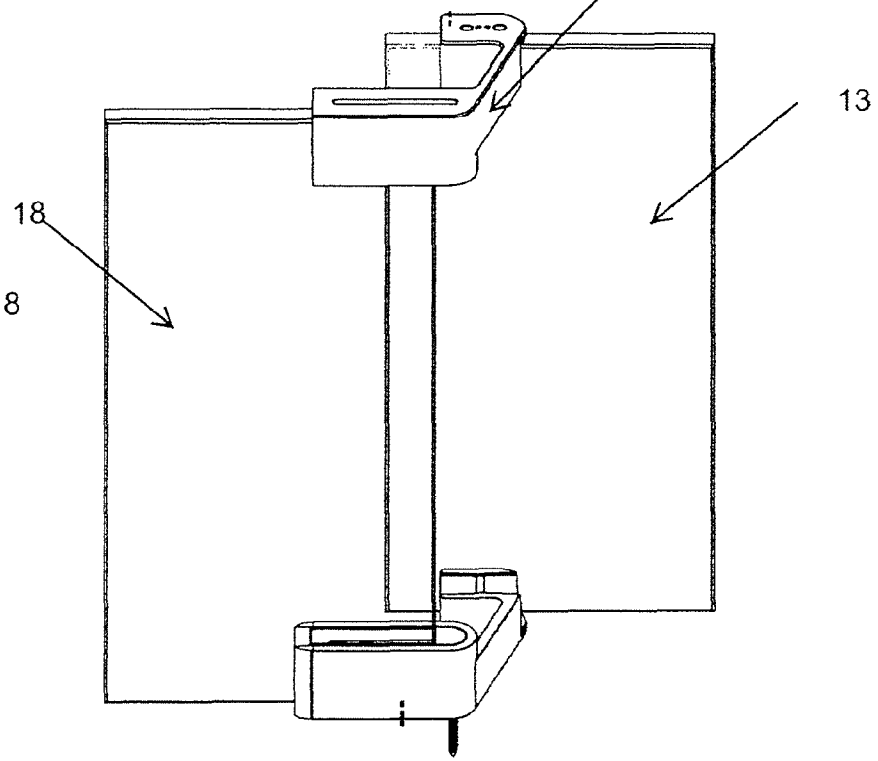
Figure 24A:
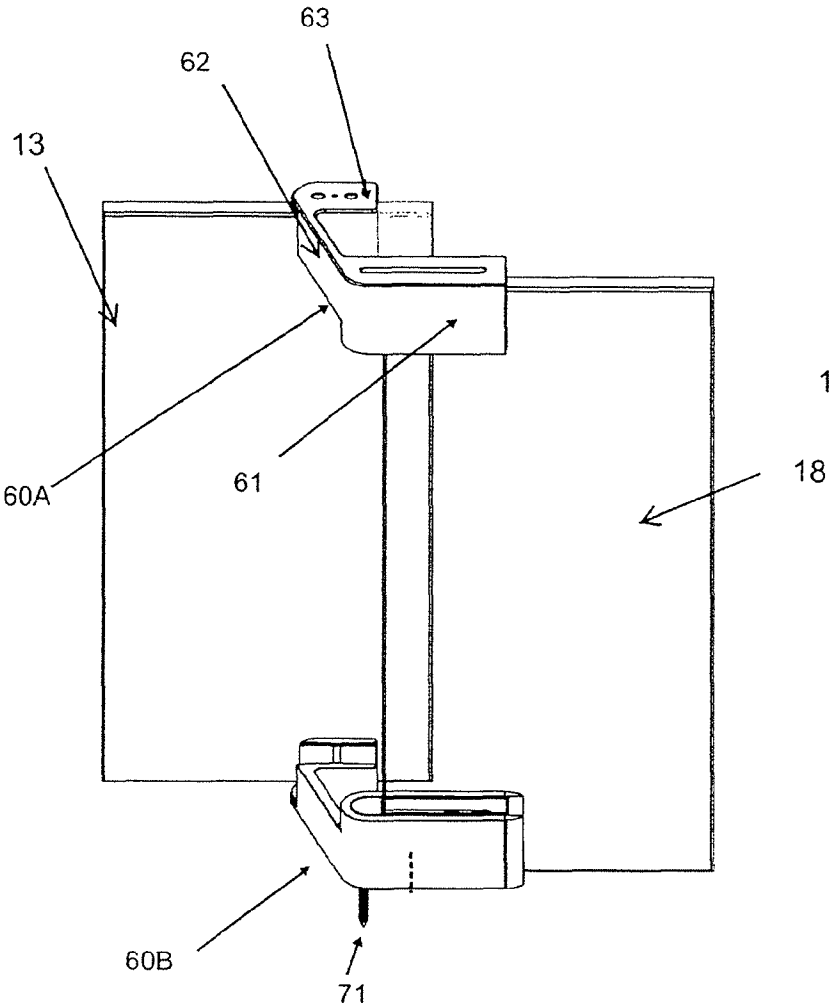

As best illustrated in FIGS. 24A and 24B the brackets 60A and 60B can be manufactured in a mirror image to be used with a left handed or right handed sliding door configuration.

Figure 25C:
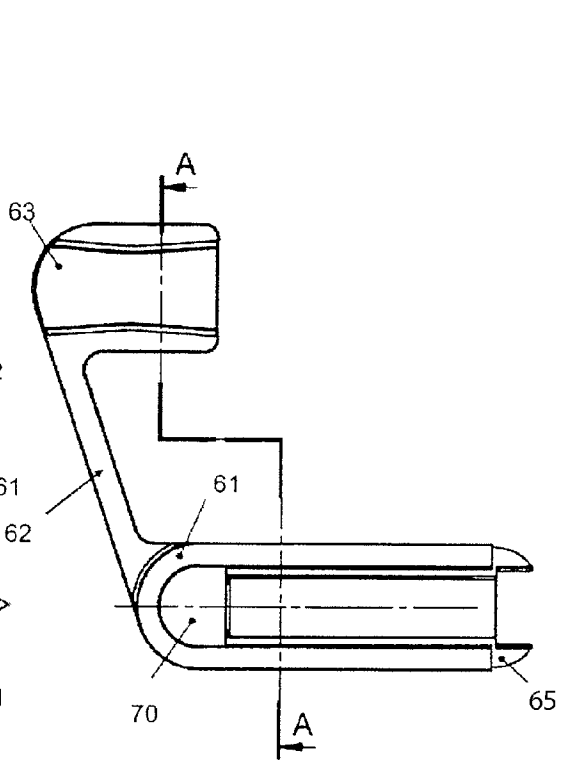
FIGS. 25 A-C illustrates an exploded, cross sectional and bottom view of the sliding bracket when used at the bottom of the door.
Figure 25B:
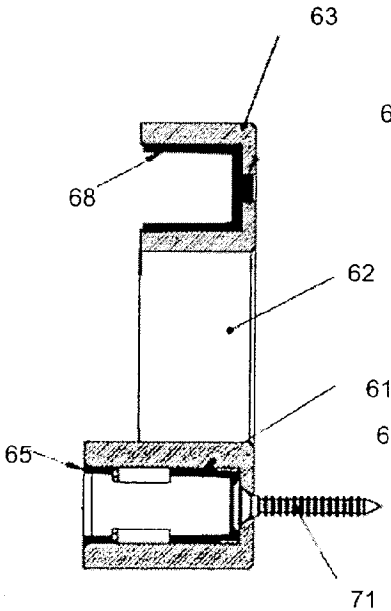
Figure 25A:
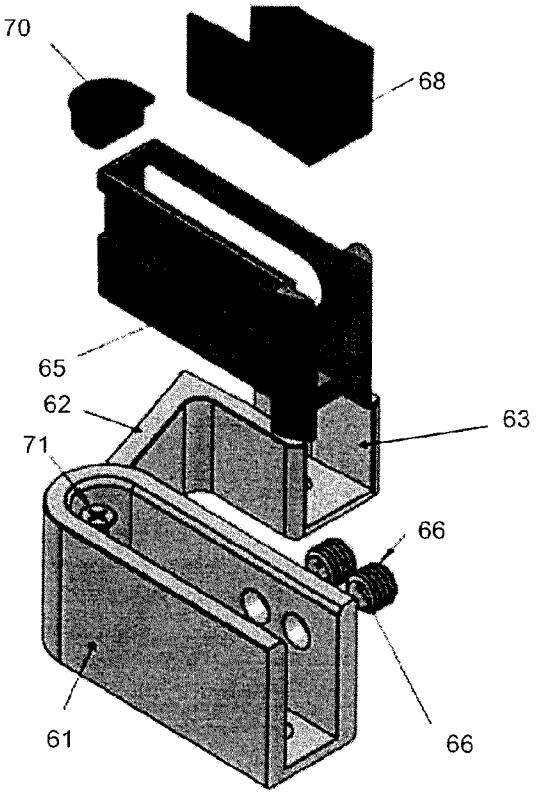

Referring now to FIG. 25A-25C, there is depicted bracket 60B in an exploded view, a cross sectional view when assembled and a top view when assembled.

Figures 26A, 26B, 26C:
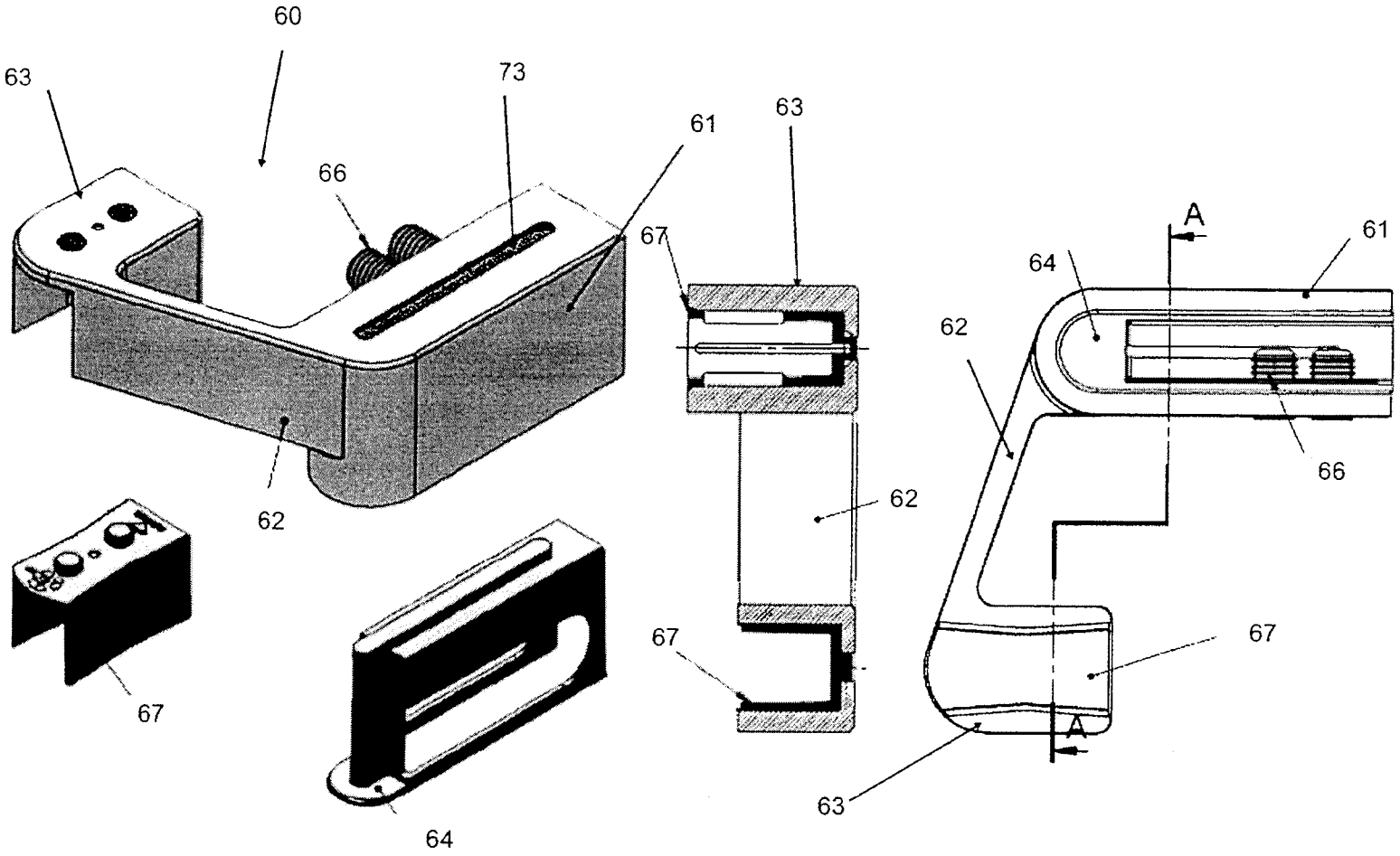
FIGS. 26 A-C illustrates an exploded, cross sectional and bottom view of the sliding bracket when used at the top of the door.

Referring now to FIGS. 26A-26C, there is depicted bracket 60A in an exploded view, a cross sectional view when assembled and bottom view when assembled.

It will be appreciated by those of ordinary skill in the art that the invention can be embodied in other specific forms without departing from the spirit thereof.

We claim:

1. A sliding door assembly for use with a tub or shower enclosure, said assembly comprising:

a rod, having a first end and a second end extending along said enclosure;

at least one door, having a top, bottom, first end, second end, first surface and second surface;

at least one roller attached to said door at a predetermined position and slidably engaging said rod;

a stopper attached to said rod, at a predetermined position;

a striker attached to said door, at a predetermined position;

said striker comprising a first side wall and a second side wall and at least one striker wing extending perpendicular to the first side wall;

said stopper defining at least one striker wing receiving slot;

wherein when said door is in a first position, said at least one striker wing and said at least one striker wing receiving slot are not engaged and when said door is in a second position, said at least one striker wing and said at least one striker wing receiving slot are engaged, said at least one striker wing entering the at least one striker wing receiving slot without friction, preventing said at least one door from substantial horizontal and vertical movement along said rod.

2. The assembly of claim 1 wherein the stopper further comprises a bumper.

3. The assembly of claim 1 wherein said door comprises at least two rollers proximate the top thereof.

4. The assembly of claim 1 wherein said striker is attached to said door proximate said at least one roller.

5. The assembly of claim 1 further comprising at least one anti jump sliding bracket.

6. A sliding door security system, said system comprising:

a) at least one sliding door supported on a rod, b) a striker member attached to the door, said striker member comprising a first side wall and a second side wall and at least one wing extending perpendicular to the first side wall, and a stopper member attached to the rod, said stopper member defining a slot to receive the wing of the striker member without friction, wherein contact between the striker and the stopper prevents the door from derailing when in use.

7. The sliding door security system of claim 6 wherein the wing of the striker member is at least partially inserted through the slot of the stopper member upon contact.

8. The system of claim 7 wherein the stopper member further comprises a bumper member.

9. The system of claim 8 wherein contact between the wing of the striker member and the slot of the stopper member substantially limits the vertical movement of the sliding door.

10. The system of claim 6 further comprising at least one anti jump sliding bracket.

* * * * *